US006162077A

United States Patent [19]

Laes et al.

[11] Patent Number: 6,162,077

[45] Date of Patent: Dec. 19, 2000

[54] MODULAR CONNECTOR WITH REDUCED CROSSTALK AND ADAPTED TO BE USED IN DIFFERENT CONTACT SETS

[75] Inventors: Robert Joseph Philippe Laes, Duffel; Paul De Win, Huizingen, both of Belgium

[73] Assignee: Alcatel, Paris, France

[21] Appl. No.: 09/406,695

[22] Filed: Sep. 28, 1999

[30] Foreign Application Priority Data

Sep. 29, 1998 [EP] European Pat. Off. ..... 98402398

[51] Int. Cl.[7] ..... H01R 29/00

[52] U.S. Cl. ..... 439/188; 439/941

[58] Field of Search ..... 439/188, 941, 439/676, 173; 200/51.09, 532

[56] References Cited

U.S. PATENT DOCUMENTS

| | | | |
|---|---|---|---|
| 5,772,465 | 6/1998 | Hwang et al. . | |
| 5,779,503 | 7/1998 | Tremblay et al. . | |
| 5,830,005 | 11/1998 | Watanabe | 439/418 |
| 5,899,770 | 5/1999 | Ezawa | 439/418 |
| 5,989,071 | 11/1999 | Larsen et al. | 439/676 |
| 6,017,237 | 1/2000 | Sullivan | 439/392 |
| 6,079,996 | 6/2000 | Arnett | 439/188 |
| 6,080,007 | 6/2000 | Dupuis et al. | 439/418 |
| 6,083,052 | 7/2000 | Adams et al. | 439/676 |

FOREIGN PATENT DOCUMENTS 0 755 100 A2 1/1997 European Pat. Off. .

*Primary Examiner*—Steven L. Stephan
*Assistant Examiner*—Thanh-Tam Le
*Attorney, Agent, or Firm*—Sughrue, Mion, Zinn, Macpeak & Seas, PLLC

[57] ABSTRACT

The invention relates to a contact set for connecting a multi-pair communication cable having wire pairs, in particular individually shielded four wire pairs. The set comprises a male connector provided to be plugged into a female connector, the male connector comprising a first (1), a second (2), a third (3) and a fourth (4) pair of connection pins provided for being connected to corresponding wires of the wire pairs. According to the invention, the male connector further comprises a central (5) and a further (6) pairs of connection pins forming an aligned series of pins with the third and fourth pairs of pins, wherein the central pair is located in the middle of the series and the two pins of the further pair of pins are located on both sides of the central pair of pins, the third and fourth pairs of pins being each located at a respective extremity of the series. The central and further pairs of pins are respectively connected to electrical contacts (18, 19) connecting them, preferably by default, to the first pair and second pairs of pins, in such a manner that upon connection into a female connector of a first type ("category 7") having corresponding first and second pairs of pins, the electrical contacts are released, whilst upon connection into a standard RJ-45 female connector ("category 5 or 6") consisting of four aligned pairs of pins mating in the series of first, second, central and further pairs of pins, the electrical contacts are held. The electrical contacts may be operated automatically by means of a protrusion (8) or manually by means of a switch or protuberance (7).

13 Claims, 8 Drawing Sheets

MODULAR CONNECTOR WITH REDUCED CROSSTALK AND ADAPTED TO BE USED IN DIFFERENT CONTACT SETS

BACKGROUND OF THE INVENTION

The present invention relates to a contact set for connecting a multi-pair communication cable having wire pairs, in particular individually shielded wire pairs, said set comprising a male connector provided to be plugged into a female connector, said male connector comprising a first, a second, a third and a fourth pair of connection pins separated as far as possible from each other and provided for being connected to corresponding wires of said pairs.

Such a contact set is already known in the art, e.g. from the European Patent Application EP-A2-0 755 100 "Contact set for twisted pair cable with individually shielded pairs". The contact set is quite small and, consequently, the wires are very closely spaced therein. As a result, there exists a crosstalk problem between adjacent wire pairs. The known Patent Application claims to solve that problem by arranging the four pairs of connection pins with a 90° twist in relation to a nearest neighbor pair. By separating as far as possible from each other the four pairs of connection pins, crosstalk between the different pairs is considerable reduced, providing in such a manner a good transmission characteristics up to and possibly beyond 600 MHz.

However, a drawback of this known contact set is that the male connector presents a specific configuration for high frequency applications so that only a female connector having a corresponding specific configuration may be mated in this male connector. In particular, this known male connector may not be mated in a known RJ-45 female connector.

SUMMARY OF THE INVENTION

The object of the present invention is to provide a contact set which allows transmission at high frequencies, in particular up to and possibly beyond 600 MHz, as for the known "category 7" connectors, but wherein the male connector is also compatible for plugging in known RJ-45 female connectors adapted to operate at lower frequencies of about 200 MHz, as for the known "category 6" connectors, or 100 MHz, as for the known "category 5" connectors such as standardized by IEC 60603.

According to the invention, this object is achieved due to the fact that said male connector further comprises a central pair and a further pair of connection pins in such a manner as to form an aligned series of connection pins with said third and fourth pair of connection pins, wherein said central pair is located in the middle of said series and the two pins of said further pair are located on both sides of said central pair, said third and fourth pairs being located at a opposite extremities of said series, that said male connector includes an interface means having a front end connected to said first, second, third, fourth, central and further pairs of connection pins and being provided with a first, a second, a third and a fourth pair of terminals to which the wire pairs of said communication cable are connected, and that said interface means comprises an electrical contact means having a first and a second contact status and being adapted, in said first contact status, to set a first connection between said first pair of terminals and said central pair of connection pins as well as a second connection between said second pair of terminals and said further pair of connection pins, and, in said second contact status, to reset said first and second connections.

In this way, the so formed configuration of eight aligned connection pins comprising the third and fourth pairs of pins as well as the additional pairs of connection pins, i.e. the central and further pairs of pins, corresponds to the configuration of a standard RJ-45 connector. The male connector of the present invention is further compatible for plugging in a known RJ-45 female connector. By the provision of the electrical contact means being set in the first contact status, the electrical signals, when using a standard RJ-45 connection, are transmitted from the central and further pairs of connection pins to the first and second pairs of terminals respectively, and vice versa. On the other hand, when plugging in a female connector having connection means mating the corresponding first and second pairs of connection pins of the present mole connector, the electrical contact means, set in the second contact status, prevents the above transmission so that electrical signals will only be transmitted from wire pairs to the first, second, third and fourth pairs of contact pins of the present male connector via the first, second, third and fourth pairs of terminals respectively, and so further to the mating connection means of the female connector, and vice versa.

The latter transmission may be achieved with high frequencies because the first, second, third and fourth pairs of connection pins of the male connector are sufficiently spaced apart from each other, i.e. at the edges of the front side of the connector, and because the central and further pairs of connection pins do not receive electrical signals, the electrical contacts with the first and second pairs of connection pins being released. Thus, the electrical signals do also not reach the central and further pairs of the female connector. This results in an absence of crosstalk between these pins.

In a preferred embodiment, said interface means comprises a first and a second insulating plate, a front end of said first insulating plate is provided, at an upper side, with said third, fourth, central and further pairs of connection pins and, at a lower side, with said first and second pairs of connection pins, the tail portion of said first insulating plate, at the opposite of said front end, being provided with said first, a second, a third and a fourth pairs of terminals, said first insulating plate is further provided with carrier strips connected to said pairs of connection pins and of terminals and having ends extending at the lower side of said first insulating plate, said second insulating plate has an upper side provided with metallic strips, and said second insulating plate is adapted to shift along said first insulating plate so as to interconnect, via said metallic strips, ends of said carrier strips, said ends and said metallic strips forming part of said electrical contact means.

In this way, the carrier strips forming an interface means are separated as much as possible in the area between the front end and the tail portion of the male connector. As a result, the crosstalk and more particularly the Near End CrossTalk (NEXT) is improved.

Another characteristic feature of the present invention is that the front side of said second insulating plate is provided with a protrusion adapted to be engaged into a mating hole of a female connector of a first type, said protrusion extending outside a housing of said male connector when said electrical contact means is in said second contact status.

If the female connector of the first type is a "category 7" connector, it will be provided with the mating hole so that the first, second, third and fourth pairs of connection pins will be used and that no signal is available on the central and further pairs of connection pins. The mating hole may for instance be provided with electrical contacts to automatically switch the female connector to the high speed status when the protrusion is engaged in the hole. On the other hand, a female connector of the "category 5" or "category 6" type, say of a second type, is not provided with such a hole. As a consequence, the protrusion must be retracted to allow the present male connector to be inserted into such a female connector. The retraction of the protrusion corresponding to the electrical contact means to be set in the first contact status, signals may then be transmitted between the central and further pairs of connection pins and the first and second pairs of terminals.

Also another characteristic feature of the present invention is that said a lateral side of said second insulating plate is provided with a protuberance accessible from outside of a housing said male connector through an opening for allowing to switch between said first and said second contact status by shifting said second insulating plate with respect to said first insulating plate.

The switching between the first and the second status of the electrical contact means, i.e. between category 5/6 and category 7 connector types, may thus be manually performed by means of this protuberance. Different embodiments of the protuberance are possible, it may for instance extend outside the housing of the male connector in such a way that it is controlled by the housing of the female connector instead of being manually controlled. Indeed, the female connector may be so designed that it either allows the protuberance to enter in a notch of its housing or abuts against it in order to switch the electrical contact means automatically to the first contact status, e.g. for category 5/6 connectors.

A variant of the present invention is characterized in that said electrical contact means is set by default into said second contact status by spring means adapted to press said second insulating plate into a corresponding position.

It is to be noted that said first insulating plate may be provided with a compensation area.

Such a compensation area is well known in the art for allowing to improve thereon EMC, crosstalk and other high speed requirements.

Preferably, said terminals are aligned on said interface means in a sequential order corresponding to the order of the wire pairs in said communication cable.

According to current telecommunication industry standards in interconnecting twisted wire pairs, e.g. category 5, and as already mentioned above, it is known that the wires of the pairs which form the tip and ring wires of a transmission system must be coupled within the connector in a particular order. More particularly, the first and the second pair of connection pins are located at opposite extremities of an aligned series, the third pair is centrally positioned, and the fourth pair straddles the third pair. On the other hand, the twisted pairs in the communication cable are aligned in a different sequential numerical order than the connection pins. It is however preferable that the pairs of terminals at the tail portion of the interface means are aligned in the same sequential numerical order than the twisted pairs in order to significantly improve the crosstalk at the location of the interconnection between the wire pairs of the communication cable and the pairs of terminals at the tail portion of the connector. This is possible owing to the carrier strips on the upper and, if any, on the lower side of the first insulating plate that allow cross connections between the connection pins and the terminals.

In a different embodiment of the present invention, said electrical contact means is further adapted, in said second contact status, to set a third connection between said first pair of terminals and said first pair of connection pins as well as a fourth connection between said second pair of terminals and said second pair of connection pins, while maintaining reset said first and second connections.

This embodiment is however less preferred because of the higher number of ends of carrier strips and contacts that have generally negative effects in high frequency applications.

Preferably said first insulating plate is a multi-layer Printed Circuit Board (PCB).

In order to further reduce the above outlined crosstalk problem, each of said first and second pairs of connection pins is provided in a corresponding holder part, each holder part being separated from one another by means of a shield and/or said first insulating plate comprises two insulating layers separated by a shielding layer.

Further characteristic features of the present contact set are mentioned in the appended claims.

BRIEF DESCRIPTION OF THE DRAWING

The above and other objects and features of the invention will become more apparent and the invention itself will be best understood by referring to the following description of an embodiment taken in conjunction with the accompanying drawings wherein:

Referring to FIGS. 1 and 2, there is illustrated a male connector according to the invention. This connector comprises a first 1 and a second 2 pair of connection pins located in a holder part or housing 9 of the connector. The pairs of connection pins 1 and 2 are positioned at the lower side of a front end of the housing 9 and are separated as far as possible from each other. The front end of the housing 9 is designed for mating into a RJ-45 female connector as will be described further. To this end, the upper side of the front end further comprises another series of connection pins: at a first extremity of the series a third pair of connection pins 3 and at the other extremity a fourth pair of connection pins 4.

Figure 1:
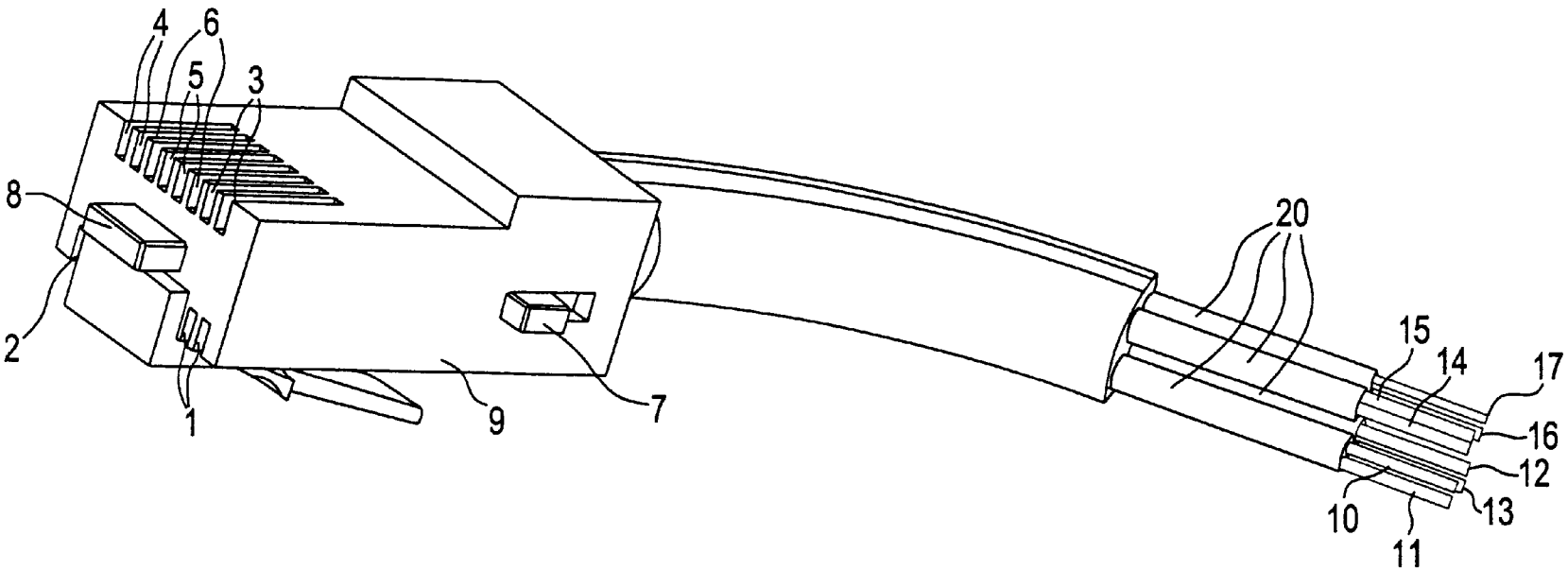
FIG. 1 is a perspective view illustrating the front part of a male connector in high speed configuration, e.g. "category 7", according to the invention.
Figure 2:
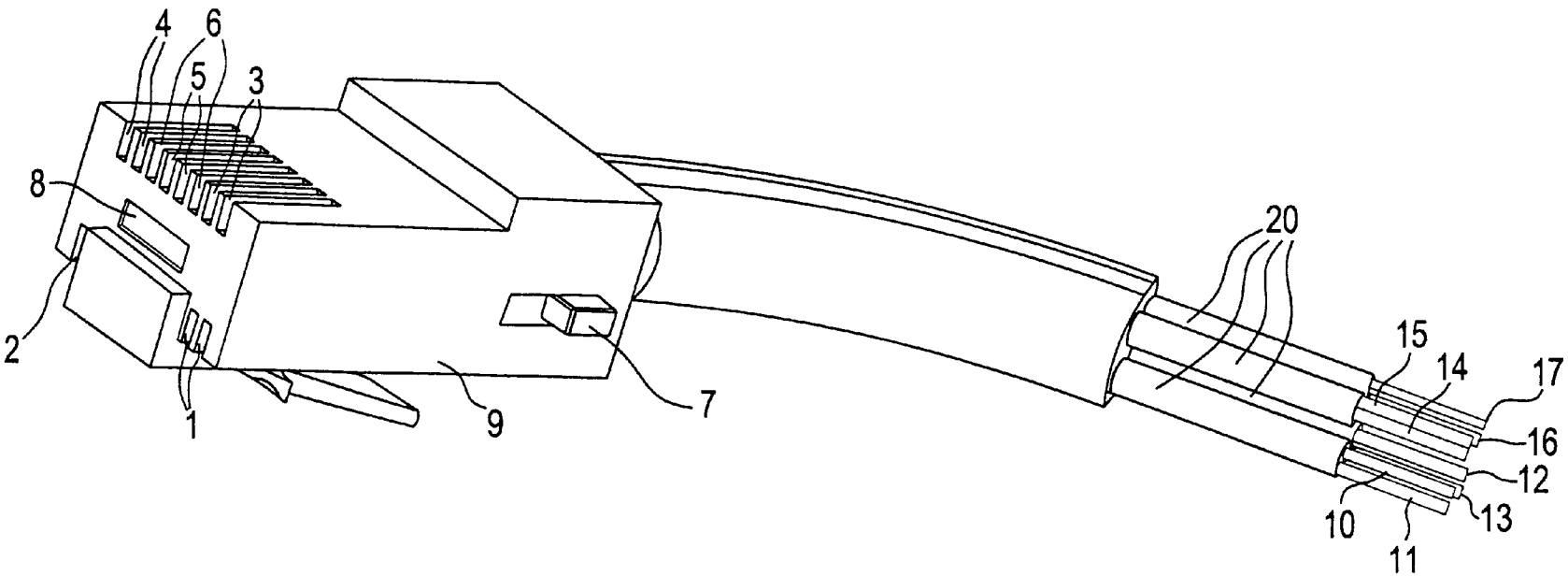
FIG. 2 is a perspective view illustrating the front part of the male connector of FIG. 1 in low speed configuration, e.g. "category 5"

Opposite to this front end, the housing 9 has a tail portion designed to receive a four twisted wire pairs communication cable. The cable includes series of eight wires 10 to 17 for being connected to the pairs connection pins 1 to 4. The pairs of wires are separated from one another in order to reduce crosstalk at their connection with the connection pins. Preferably, each pair of wires is shielded, as generally referred to by 20 in the FIGS. 1 and 2.

Since the pairs of connection pins 1 to 4 are separated as much as possible from each other, the present male connector suits perfectly for broadband or high frequency applications as it is the case for the known "category 7" connectors (hereafter referred to as "cat7").

However, according to the invention, the present male connector is further adapted to receive any RJ-45 female connector and to operate also as a standardized "category 5" or a known "category 6" connector (hereafter commonly referred to as "cat5/6").

To this end, the male connector is further provided with a central pair 5 and a further pair 6 of connection pins, so as to mate with the corresponding connections provided in a standard RJ-45 female connector.

Figure 3:
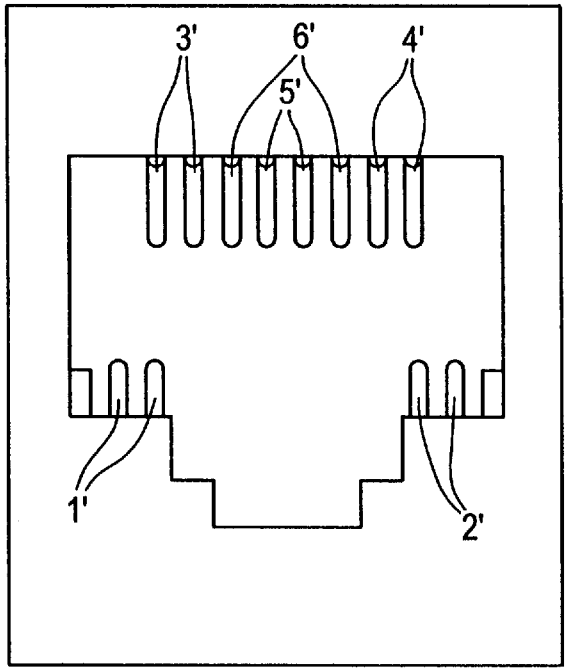
FIG. 3 illustrates a perspective view of the front part of a female connector, of a first type, mating the male connector according to FIG. 1.

A perspective view of the front part of a cat7 female connector is shown at FIG. 3. Therein, the connections 1' to 6' are designed to be brought into contact with the respective pairs of connection pins 1 to 6 of the male connector.

Figure 4:
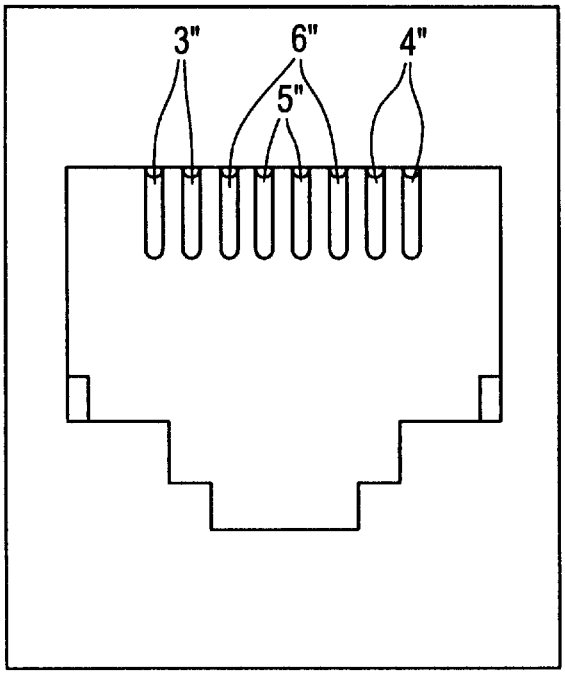
FIG. 4 illustrates a perspective view of the front part of a standard RJ-45, or second type, female connector mating the male connector according to FIG. 2.

A perspective view of the front part of a standard RJ-45 female connector is shown at FIG. 4. Therein, the connections 3" to 6" are designed to be brought into contact with the respective pairs of connection pins 3 to 6 of the male connector.

Figure 5:
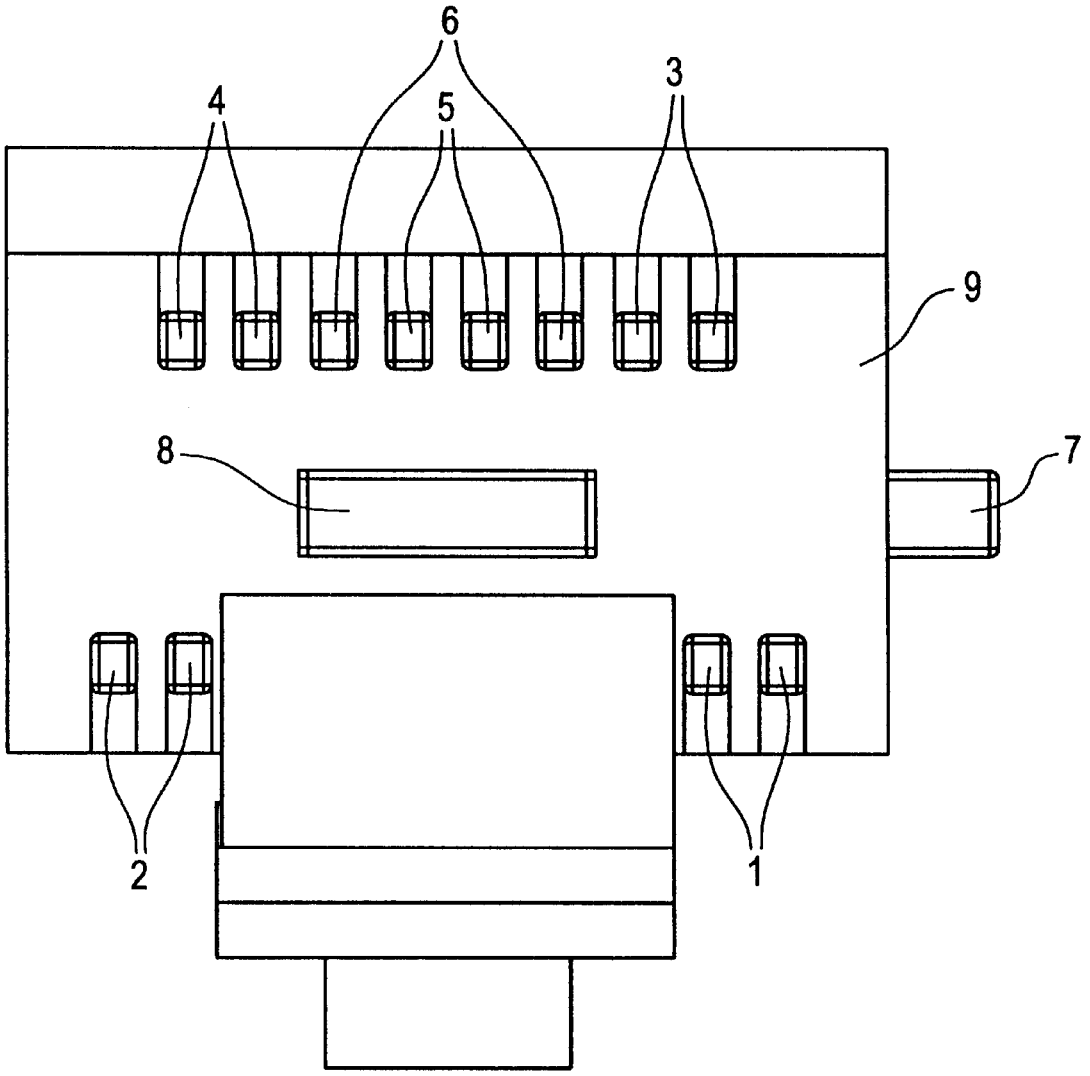
FIG. 5 illustrates a front view of the male connector according to FIG. 1.

FIG. 5 illustrates the front view of the male connector as described above.

Although not shown, and in order to further reduce interference, each pair of connection pins in the male connector may be provided in a corresponding holder part, each holder part being separated from one another by means of a shield. Preferably, this shield will be provided for grounding the central 5 and/or further 6 pair of connection pins of the male connector upon connection of a female connector of cat7.

Referring again to the FIGS. 1 and 2, a protrusion 8 extends at the front side of the housing 9 of the male connector. This protrusion 8 only changes the functionality of the male connector in combination with a female connector having similar functionality. The protrusion 8 can be engaged in a mating hole of a female connector adapted thereto. The mating hole may for instance be provided with electrical contacts to automatically switch the female connector to the high speed configuration, e.g. cat7, when the protrusion 8 is engaged in the hole.

A protuberance 7 is accessible through an opening of the housing 9 for allowing to switch between the high speed (cat7) and low speed (cat5/6) configurations. The switch can be manual or automatic. The manual switch is operated by shifting the protuberance 7 from left to right as can be seen between the FIGS. 1 and 2. As will become clear later, the protuberance 7 and the protrusion 8 are linked so that they are dependently and simultaneously shifted from left to right, and vice versa. The automatic switch is operated at introduction of the male connector, or plug, into a female connector, or jack, the plug then automatically recognizes the configuration it has to apply. For instance, if the female connector is a cat7 connector, it will be provided with a blind hole mating the protrusion 8. As already mentioned, an RJ-45 compatible high speed female connector is illustrated at FIG. 3. The high speed is realized by transmitting signals through the pairs 1', 2', 3' and 4'. The extended distance between the different pairs helps in meeting the very severe Near-End-Crosstalk-performance. On the contrary, a cat5/6 female connector is not provided with such a hole so that the protrusion 8 is then, by insertion of the male connector, pressed to retract into the housing 9, i.e. to the right. As result, the male connector is automatically switched to the low speed configuration. In another embodiment, the female connector may for instance be provided with a housing allowing or not the protuberance 7 to shift in a notch thereof. Here again a cat5/6 female connector will not be provided with such a notch and thereby presses against the protuberance 7 to shift to the right for switching the male connector to the low speed configuration. Preferably, the male connector should be provided with spring means to maintain, by default, the switch in the high speed configuration, i.e. with the protrusion 8 extending outside the housing 9.

Figure 6:
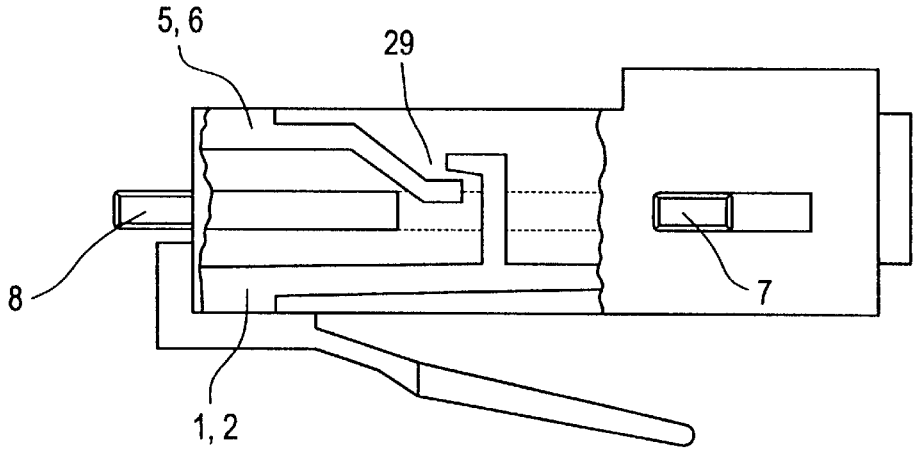
FIG. 6 is a side sectional view showing the switch principle in the male connector according to high speed configuration of FIG. 1.
Figure 7:
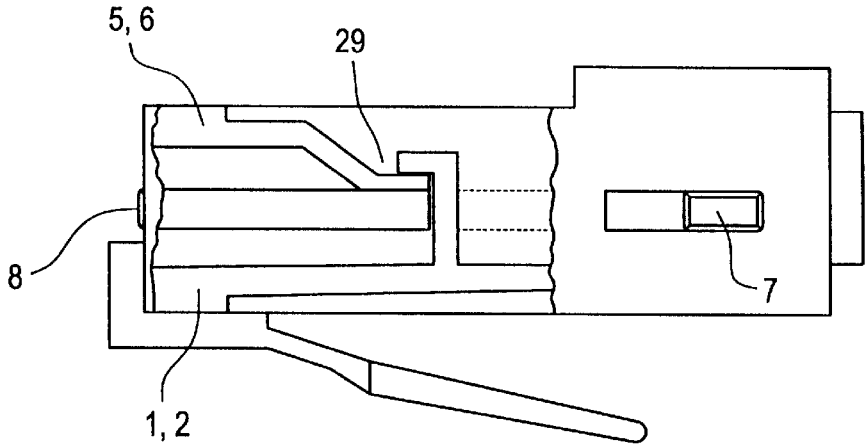
FIG. 7 is a side sectional view showing the switch principle in the male connector according to the low speed configuration of FIG. 2.
Figure 8:
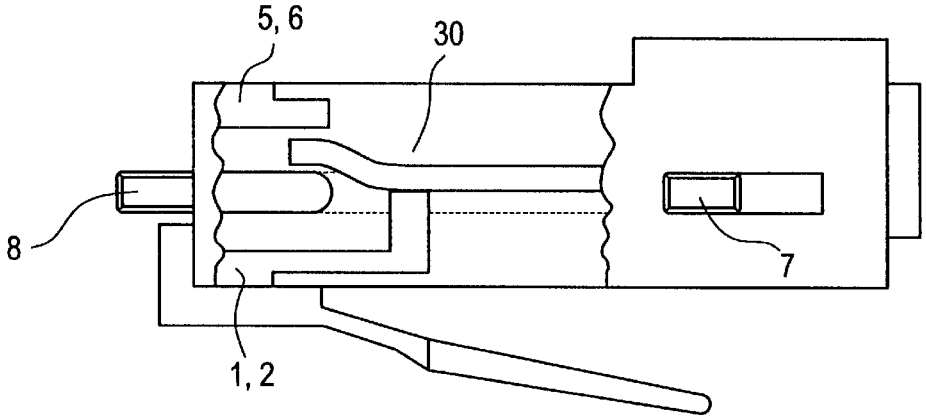
FIG. 8 is a side sectional view showing the switch principle in the male connector according to another possible switching mechanism.

The FIGS. 6, 7 and 8 illustrate a possible embodiment of the electrical contact means inside the male connector.

FIG. 6 shows that an internal electrical contact 29 is open, say in a second contact status, when the protrusion 8 extends outside the housing, thereby preventing the central 5 and the further 6 pairs of connection pins of the male connector to be electrically connected to the first 1 and the second 2 pairs of contact pins. When plugging into a female connector having corresponding first 1' and second 2' pairs of connections (as shown at FIG. 3), electrical signals may be transmitted between first 10, 11 and second 12, 13 pairs of wires of the communication cable and these pairs of connections 1' and 2' via the respective pairs of connection pins 1 and 2, but not to the pairs of connection pins 5 and 6. The signal transmitted through the third 3 and fourth 4 pairs of wires will be transmitted via the interconnection of the connection pins 3 and 4 to the respective connections 3' and 4'.

As already mentioned and as clearly illustrated in FIG. 5, since these interconnections 3'–3 and 4'–4 are located at the extremities of a series of aligned pins, crosstalk between the pairs of connections and connection pins is rather limited, even with high transmission frequencies up to and beyond 600 MHz, as it is the case with cat7 contact sets.

FIG. 7 illustrates a second contact status of the electrical contact means 29 that guarantee the transmission of signals between wires connected to the male connector and wires connected to the female connector. In other words, the electrical contact 29 is closed, say in a first contact status, when the protrusion 8 is retracted into the housing, i.e. when the protuberance 7 is shifted to the right. In this latter case, the central 5 and the further 6 pairs of connection pins of the male connector are electrically connected to the first 1 and the second 2 pairs of contact pins, respectively. However, as can be seen at FIG. 4 that illustrates a standard RJ-45 female connector, when plugging the male connector in such a standard female connector, the first 1 and second 2 pairs of pins are not connected to corresponding connections of the female connector, although there are pairs of wires connected to the pairs connection pins 1 and 2 in the male connector. The signals can then only be transmitted between the central 5 and further 6 pairs of connection pins of the male connector and the corresponding connections 5" and 6" of the female connector.

FIG. 8 illustrates a variant of an electrical contact 30 for connecting pairs of wires to corresponding first 1 and second 2 pairs of connection pins or to corresponding central 5 and further 6 pairs of connection pins. Instead of a permanent direct connection between the 2 pairs of wires to the corresponding pairs of pins 1 and 2, the electrical contact 30 is a change-over switch that connect the wire pairs either to the pairs of connection pins 1 and 2 or to the pairs of connection pins 5 and 6, according to the position of the protrusion 8 and the protuberance 7. In case of a high speed application, a connection is made between the pairs of connection pins 1, 2 and their corresponding pairs of wires. The central 5 and further 6 pairs of connection pins are then prevented to transmit signals. In case of low speed application (not shown), a connection is made between the central 5 and further 6 pairs of connection pins and the corresponding pairs of wires, whilst signals are prevented to be transmitted to the pairs of connection pins 1 and 2.

Figure 9:
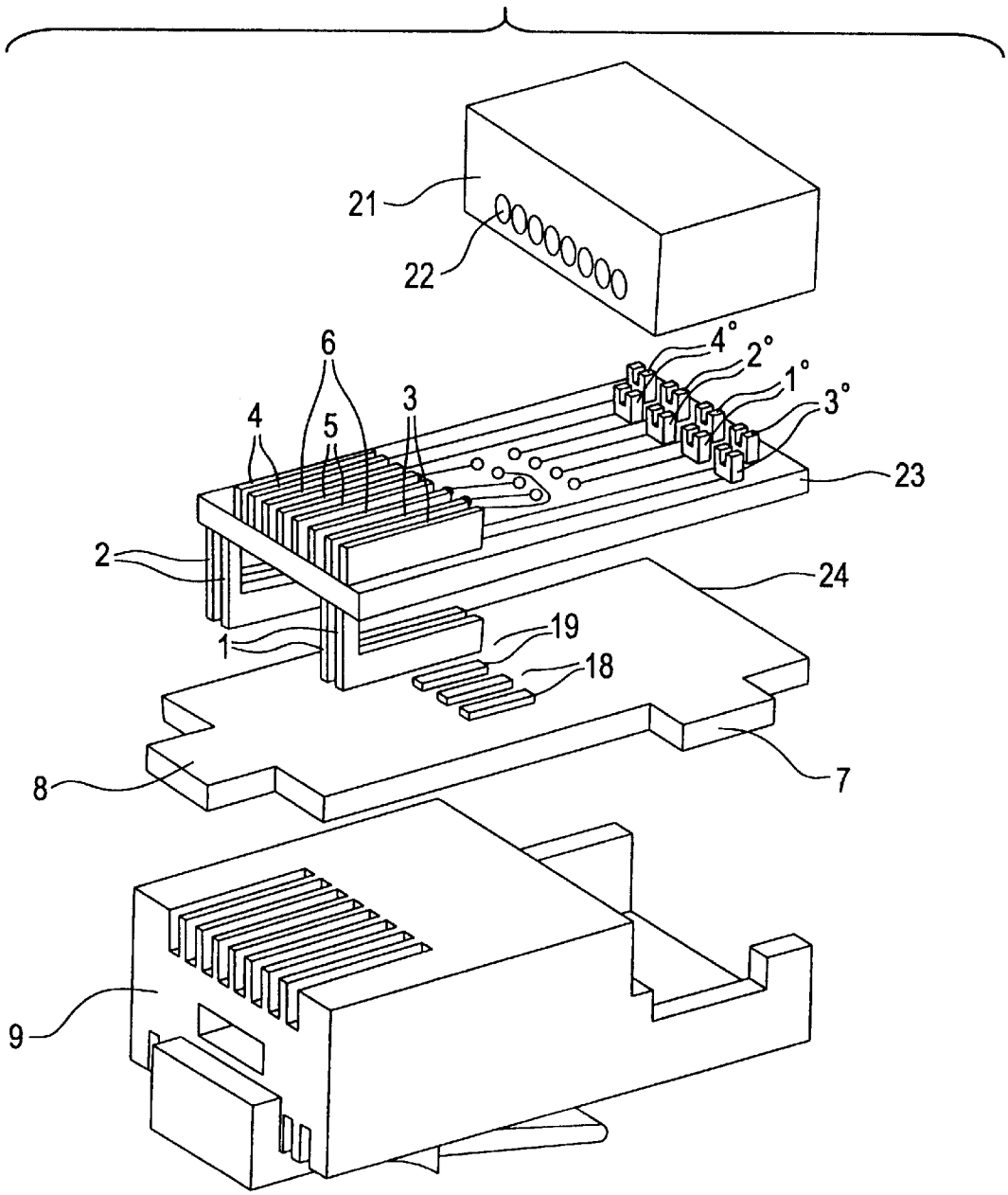
FIG. 9 is a component breakdown of the male connector according to FIG. 1.

FIG. 9 shows a component breakdown of a preferred embodiment of the present male connector. It illustrates a wire-holder 21 located at the tail portion of the connector. The wire-holder 21 has wire holes 22 adapted to received the wires 10 to 17 of the communication cable. The wire-holder 21 is used to close the housing 9 of the connector. The wire-holder 21 may be screened or metallised to ensure better EMC and crosstalk performances.

Interface means are provided inside this housing. These interface means comprise a first insulating plate 23 adopted to cooperate with a second insulating plate 24. The front end of the first insulating plate 23 has, at an upper side thereof, the above mentioned third 3, fourth 4, central 5 and further 6 pairs of connection pins and, at its lower side, the first 1 and second 2 pairs of connection pins. The tail portion of this first insulating plate 23 has the first 1°, second 2°, third 3° and fourth 4° pairs of terminals, that will be covered by the wire-holder 21. This first insulating plate 23 is further provided with carrier strips connected to the pairs of connection pins 1 to 6 as well as to the pairs of terminals 1° to 4°. Some of these carrier strips have ends extending at the lower side of the first insulating plate 23. The second insulating plate 24 has an upper side provided with metallic strips 18 and 19, adapted to cooperate with the ends of carrier strips of the plate 23 so as to form a switch. In more detail, this second insulating plate 24 is adapted to shift along the first insulating plate 23 thereby interconnecting or not, via the metallic strips 18 and 19, ends of the carrier strips, these ends and metallic strips forming the electrical contacts of the above mentioned switch. It is to be noted that the second insulating plate 24 is provided with the protrusion 8 and the protuberance 7.

Figure 10:
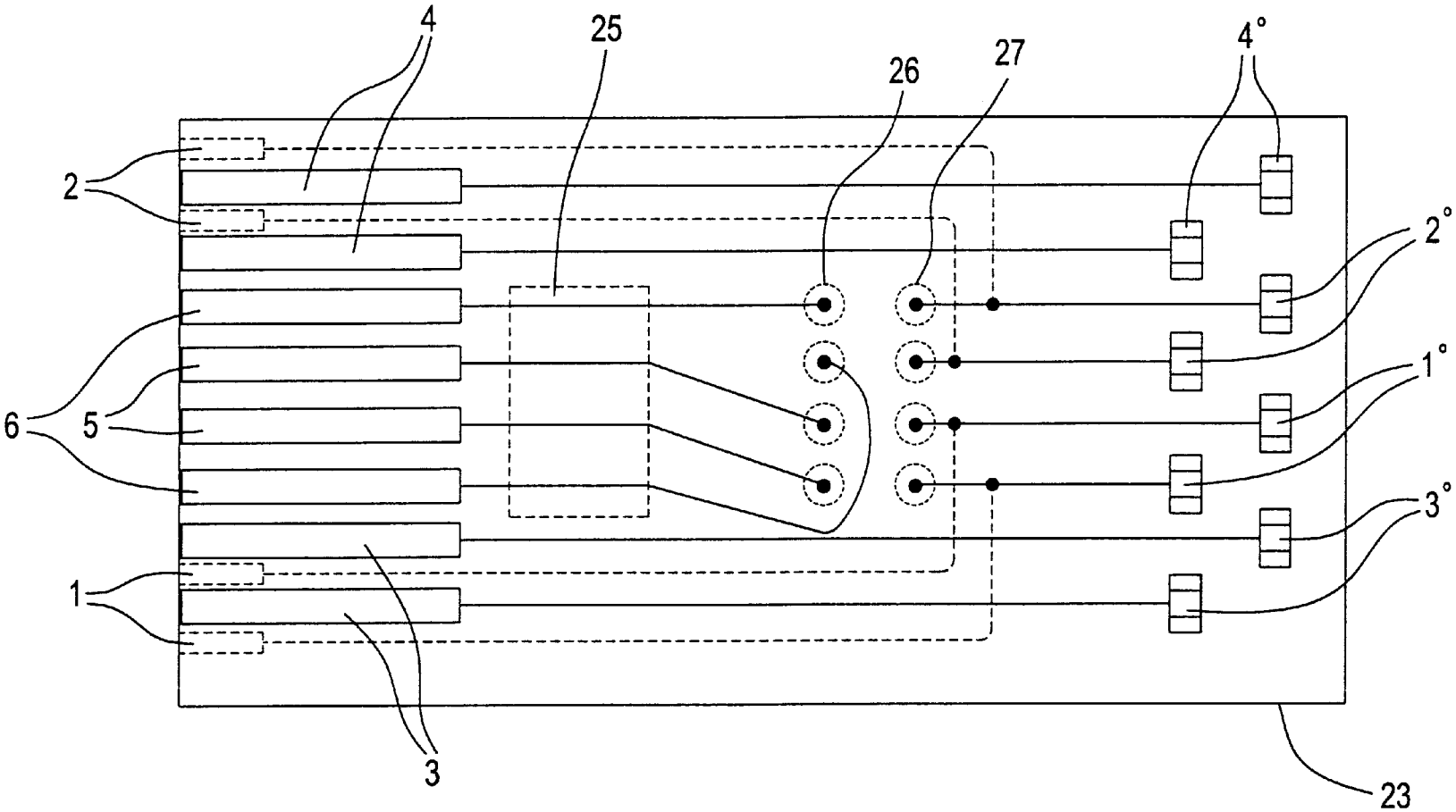
FIG. 10 is an illustration of the insulating plate 23 of FIG. 6, used to switch of contact status and to change from configuration as from FIG. 1 to FIG. 2.

A top view of the first insulating plate 23 is shown at FIG. 10. Therein can be seen that the carrier strips connected to the central pair 5 and the further pair 6 of connection pins of the male connector can be electrically connected to carrier strips connected to the first pair 1° and the second pair 2° of terminals, via the ends 26 and 27 of these carrier strips and by means of electrical connections made between these ends by the metallic strips 18 and 19 placed on the second insulating plate or switch support 24. When plugging into a female connector having corresponding first 1' and second 2' pairs of connections, the electrical connections 18 and 19 have to be released, i.e. the plate 24 is shifted to the left, so that signals transmitted through the first 10–11 and second 12–13 pairs of wires will be transmitted through the intermediary of the pins 1–1' and 2–2' and will not pass to the pairs of pins 5 and 6. The signals transmitted through the third 14–15 and fourth 16–17 pairs of wires will be transmitted through carrier strips interconnecting directly the pairs of connection pins 3 and 4 with the pairs of terminals 3° and 4°, respectively, and via the intermediary of pins 3–3' and 4–4'. Since these pins 3–3' and 4–4' are located at the extremities of the series of pins in each connector, as clearly illustrated in FIG. 5, crosstalk between these pairs of pins is rather limited, even with high transmission frequencies up to and beyond 600 MHz.

As already mentioned, moving the electrical connections 18 and 19 is done by moving the switch support 24. This switch support will be put in motion by a protuberance or switch 7 accessible at the inside or outside of the male connector. When moving the switch support 24 by the switch 7, the electrical connections 18 and 19 will move with the same amount making or breaking contact between ends 26 and 27 at the lower or reverse side of the insulating plate 23. This insulating plate 23 is preferably a multi-layer Printed Circuit Board PCB. When the contact is broken, it means that the electrical connections 18 and 19 have been released, so that signals transmitted through the first and second pair of wires will be transmitted through the intermediary of the pins 1–1' and 2–2', and will not pass through the pins 5 and 6.

Returning to the FIGS. 2 and 4, they clearly show that, when plugging this previously described male connector in a standard RJ-45 female connector, called RJ-45 jack, the first 1 and second 2 pairs of connection pins are riot directly connected to the corresponding connections or pins of the female connector. There are however pairs of wires connected to those pins 1 and 2.

FIG. 9, together with FIG. 10, illustrate the electrical connections 18 and 19 that guarantee the transmission of signals from the corresponding wires from the male connector to wires from the female connector, since the signals are transmitted from the first 1 and second 2 pairs of pins to the central 5 and further 6 pairs of pins and follow the path 1-5-5" and 2-6-6".

In order to transmit from the first 1 and second 2 pair of connections pins, and thus from the first 1° and second 2° pairs of terminals, to the central 5 and further 6 pairs of connection pins, the electrical contact between the ends 26–27 has to be closed. This is done by moving the metallic strips or electrical connections 18 and 19 through the switch support 24 using the switch 7. When the contact is made or restored, it means that the electrical connections 18 and 19 have been made, so that signals transmitted through the first and second pair of wires will be transmitted through the intermediary of pins 1-1' and 2-2', and will pass through the pairs pins 5 and 6.

Next to the switch function, i.e. near to the ends of carrier strips or contact points 26 and 27, is provided a "compensation area" 25 as well known by the person skilled in the art. The compensation area 25 is used for improving EMC, crosstalk and other high speed requirements, e.g. by twisting the carrier strips thereon. The use of a PCB as insulating plate 23 in this male connector enables to optimize the space and the performance of the connector. Lengths of different wires can be matched, Near End CrossTalk compensation (NEXT) can be introduced, and especially cross-over of wires can be realized. In the case of high speed transmission, i.e. cat7, the connections are made without interruption points. Signal will be transported from wires trough pair of terminals 1°, 2°, 3° and 4° to respectively pair of pins 1, 2, 3 and 4, whilst no signal will be available on central pair 5, nor on further pair of pins 6. In case of low speed transmission, i.e. cat5/6, the switching mechanism will make a connection between pair of pins 6 with pair of pins 2 and between pair of pins 5 with pair of pins 1. Cross-over is realized for several pins in this design.

In a preferred embodiment, the PCB 23 as an additional shielding layer (not shown) that separates in two parts the first insulating plate.

Figure 11:
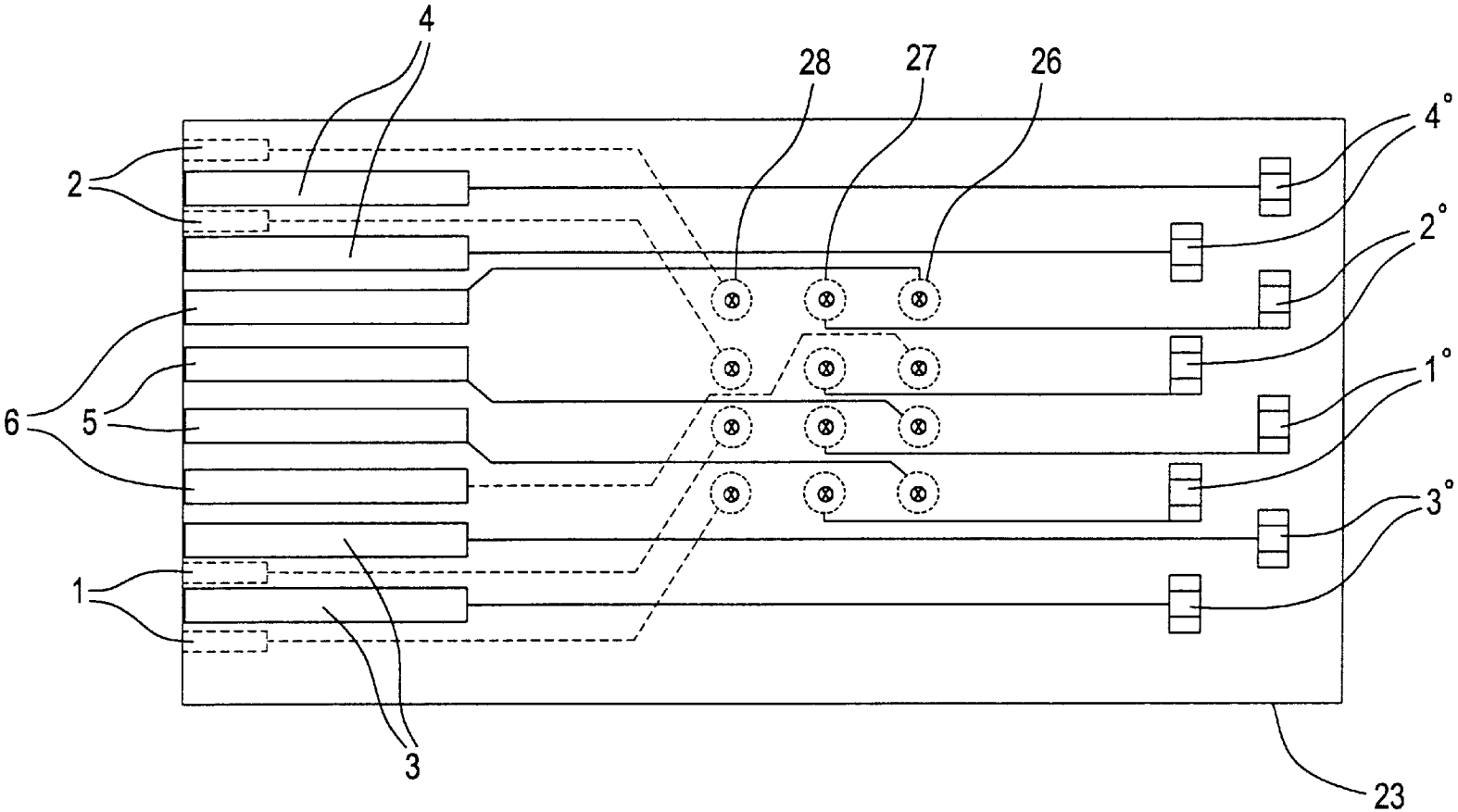
FIG. 11 is an illustration of a variant of the insulating plate 23 of FIG. 7.

FIG. 11 illustrates a variant and less preferred method of connecting pairs of wires to corresponding pairs of pins 1 and 2 and the central pair 5 and further pair 6 of connection pins. In this embodiment, carrier strips having ends 26 are connected to the central 5 and further 6 pairs of connection pins, carrier strips having ends 27 are connected to the first 1° and second 2° pairs of terminals, and carrier strips having ends 28 are connected to the first 1 and second 2 pairs of connection pins. These ends 26, 27 and 28 extend at the lower side of the first insulating plate 23 and can be brought into contact with the metallic strips 18 and 19 of the second insulating plate 24. Therefore, instead of a direct connection between the 2 pairs of wires 10–11, 12–13 to the corresponding pairs of pins 1 and 2 as in FIG. 10, the electrical connections 18 and 19 form a cross-over switch that make or break the contact between both. In case of high speed application, a connection is made between the pairs of connection pins 1,2 and their corresponding pairs of wires 10–11, 12–13 via the pairs of terminals 1°, 2° and a short between the ends or contact pins 28 and 27. The central 5 and further 6 pairs of pins don't transmit signals. In case of low speed application, a connection is made between the central 5 and further 6 pairs of pins to respectively pairs of terminals 1° and 2°, via a short between contact pins 27 and 26. The first 1 and second 2 pairs of connection pins will then not transmit signals.

While the principles of the invention have been described above in connection with specific apparatus, it is to be clearly understood that this description is made only by way of example and not as a limitation on the scope of the invention, as defined in the appended claims.

What is claimed is:

1. Contact set for connecting a multi-pair communication cable having wire pairs (10, 11; 12, 13; 14, 15; 16, 17), in particular individually shielded (20) wire pairs, said set comprising a male connector provided to be plugged into a female connector, said male connector comprising a first (1), a second (2), a third (3) and a fourth (4) pair of connection pins separated as far as possible from each other and provided for being connected to corresponding wires of said pairs, characterized in that said male connector further comprises a central pair (5) and a further pair (6) of connection pins in such a manner as to form an aligned series of connection pins with said third (3) and fourth (4) pair of connection pins, wherein said central pair is located in the middle of said series and the two pins of said further pair are located on both sides of said central pair, said third and fourth pairs being located at opposite extremities of said series, in that said male connector includes an interface means having a front end connected to said first (1), second (2), third (3), fourth (4), central (5) and further (6) pairs of connection pins and being provided with a first (1°), a second (2°), a third (3°) and a fourth (4°) pair of terminals to which the wire pairs of said communication cable are connected, and in that said interface means comprises an electrical contact means having a first and a second contact status and being adapted, in said first contact status, to set a first connection between said first pair (1°) of terminals and said central pair (5) of connection pins as well as a second connection between said second pair (2°) of terminals and said further pair (6) of connection pins, and, in said second contact status, to reset said first and second connections.

2. Contact set according to claim 1, characterized in that said interface means comprises a first (23) and a second (24) insulating plate, in that, a front end of said first insulating plate is provided, at an upper side, with said third (3), fourth (4), central (5) and further (6) pairs of connection pins and, at a lower side, with said first (1) and second (2) pairs of connection pins, the tail portion of said first insulating plate, at the opposite of said front end, being provided with said first (1°), a second (2°), a third (3°) and a fourth (4°) pairs of terminals, in that said first insulating plate (23) is further provided with carrier strips connected to said pairs of connection pins and of terminals and having ends extending at the lower side of said first insulating plate, in that said second insulating plate (24) has an upper side provided with metallic strips (18, 19), and in that said second insulating plate is adapted to shift along said first insulating plate so as to interconnect, via said metallic strips, ends of said carrier strips, said ends and said metallic strips forming part of said electrical contact means.

3. Contact set according to claim 2, characterized in that the carrier strips connected to said central (5) and further (6) pairs of connection pins and the carrier strips connected to said first (1°) and second (2°) pairs of terminals have ends (26, 27) extending at the lower side of said first insulating plate (23), said ends being adapted to be brought into contact with said metallic strips (18, 19) of said second insulating plate (24), and in that carrier strips interconnect said first (1), second (2), third (3) and fourth (4) pairs of connection pins with said first (1°), second (2°), third (3°) and fourth (4°) pairs of terminals, respectively.

4. Contact set according to claim 2, characterized in that the front side of said second insulating plate (24) is provided with a protrusion (8) adapted to be engaged into a mating hole of a female connector of a first type, said protrusion extending outside a housing of said male connector when said electrical contact means is in said second contact status.

5. Contact set according to claim 1, characterized in that said a lateral side of said second insulating plate (24) is provided with a protuberance (7) accessible from outside of a housing said male connector through an opening for allowing to switch between said first and said second contact status by shifting said second insulating plate (24) with respect to said first insulating plate (23).

6. Contact set according to claim 4, characterized in that said electrical contact means is set by default into said second contact status by spring means adapted to press said second insulating plate (24) into a corresponding position.

7. Contact set according to claim 2, characterized in that said first insulating plate (23) is provided with a compensation area.

8. Contact set according to claim 1, characterized in that said terminals are aligned on said interface means in a sequential order corresponding to the order of the wire pairs in said communication cable.

9. Contact set according to claim 1, characterized in that said electrical contact means is further adapted, in said second contact status, to set a third connection between said first pair (1°) of terminals and said first pair (1) of connection pins as well as a fourth connection between said second pair (2°) of terminals and said second pair (2) of connection pins, while maintaining reset said first and second connections.

10. Contact set according to claim 9, characterized in that the carrier strips connected to said first (1), second (2), central (5) and further (6) pairs of connection pins and the carrier strips connected to said first (1°) and second (2°) pairs of terminals have ends (26, 27, 28) extending at the lower side of said first insulating plate (23), said ends being adapted to be brought into contact with said metallic strips (18, 19) of said second insulating plate (24).

11. Contact set according to claim 1, characterized in that each of said first (1) and second (2) pairs of connection pins is provided in a corresponding holder part, each holder part being separated from one another by means of a shield.

12. Contact set according to claim 2, characterized in that said first insulating plate (23) is a multi-layer Printed Circuit Board (PCB).

13. Contact set according to claim 2, characterized in that said first insulating plate (23) comprises two insulating layers separated by a shielding layer.

* * * * *